US008246133B2

(12) United States Patent
Oshima et al.

(10) Patent No.: US 8,246,133 B2
(45) Date of Patent: Aug. 21, 2012

(54) LIQUID JET APPARATUS AND PRINTING APPARATUS

(75) Inventors: Atsushi Oshima, Shiojiri (JP); Kunio Tabata, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/689,926

(22) Filed: Jan. 19, 2010

(65) Prior Publication Data

US 2010/0118078 A1 May 13, 2010

Related U.S. Application Data

(62) Division of application No. 11/780,379, filed on Jul. 19, 2007.

(30) Foreign Application Priority Data

Jul. 24, 2006 (JP) ..... 2006-200352
Jul. 13, 2007 (JP) ..... 2007-184438

(51) Int. Cl.
*B41J 29/38* (2006.01)

(52) U.S. Cl. ..... 347/9; 347/5; 347/10

(58) Field of Classification Search ..... 347/9, 5, 347/10

See application file for complete search history.

(56) References Cited

U.S. PATENT DOCUMENTS 2,915,589 A 12/1959 Plant
4,254,439 A 3/1981 Fowler et al.
4,992,749 A 2/1991 Tokumo et al.
5,262,733 A 11/1993 Nakajima et al.
5,283,658 A 2/1994 Hayashi et al.
5,406,314 A 4/1995 Kuehnle
5,475,405 A 12/1995 Widder et al.
5,675,296 A 10/1997 Tomikawa
5,894,314 A 4/1999 Tajika et al.
6,133,844 A 10/2000 Ahne et al.
6,267,519 B1 7/2001 Otsuki et al.
6,312,076 B1 11/2001 Taki et al.
6,312,096 B1 11/2001 Koitabashi et al.
6,320,605 B1 11/2001 Ikeda et al.
6,344,811 B1 2/2002 Melanson
(Continued)

FOREIGN PATENT DOCUMENTS

EP 1594224 11/2005
(Continued)

OTHER PUBLICATIONS

U.S. Appl. No. 12/161,201, filed Jul. 17, 2008, Oshima et al.

(Continued)

*Primary Examiner* — Laura E Martin
(74) *Attorney, Agent, or Firm* — Maschoff Gilmore & Israelsen

(57) ABSTRACT

A liquid jet apparatus includes a plurality of nozzles, an actuator provided for each nozzle and connected to the respective nozzle, and a drive unit that applies a drive signal to the actuator, wherein the drive unit includes: a drive waveform signal generation unit that generates a drive waveform signal for controlling the operation of the actuator, a modulator unit that pulse-modulates the drive waveform signal to produce a modulated signal, a digital power amplifier for power-amplifying the modulated signal to produce an amplified signal, a low-pass filter for smoothing the amplified signal and supplying the actuator with the drive signal, and a carrier frequency adjusting unit that adjusts a carrier frequency of the pulse modulation by the modulator unit in accordance with the number of actuators to be driven.

2 Claims, 13 Drawing Sheets

U.S. PATENT DOCUMENTS

| | | | |
|---|---|---|---|
| 6,364,443 | B1 | 4/2002 | Katano et al. |
| 6,378,996 | B1 | 4/2002 | Shimada et al. |
| 6,431,676 | B2 | 8/2002 | Asauchi et al. |
| 6,443,547 | B1 | 9/2002 | Takahashi et al. |
| 6,454,377 | B1 | 9/2002 | Ishizaki |
| 6,457,794 | B1 | 10/2002 | Tajika et al. |
| 6,474,762 | B2 | 11/2002 | Taki et al. |
| 6,652,055 | B2 | 11/2003 | Oikawa |
| 6,739,686 | B2 | 5/2004 | Imai |
| 6,776,469 | B2 | 8/2004 | Nozawa |
| 6,929,340 | B2 | 8/2005 | Ishizaki |
| 7,038,534 | B2 | 5/2006 | Hanzlik |
| 7,083,274 | B2 | 8/2006 | Morita |
| 7,111,755 | B2 | 9/2006 | Koyama et al. |
| 7,170,544 | B2 | 1/2007 | Horiuchi |
| 7,244,007 | B2 | 7/2007 | Ishizaki |
| 7,252,355 | B2 | 8/2007 | Umeda |
| 7,357,496 | B2 | 4/2008 | Silverbrook et al. |
| 7,384,128 | B2 | 6/2008 | Sheahan et al. |
| 7,571,989 | B2 | 8/2009 | Ishizaki |
| 7,717,530 | B2 | 5/2010 | Oshima |
| 7,731,317 | B2 | 6/2010 | Oshima |
| 7,748,812 | B2 | 7/2010 | Oshima |
| 2001/0040595 | A1 | 11/2001 | Taki et al. |
| 2002/0113832 | A1 | 8/2002 | Kanematsu et al. |
| 2002/0142733 | A1 | 10/2002 | Nishinakagawa |
| 2002/0163458 | A1 | 11/2002 | Jin |
| 2003/0112297 | A1 | 6/2003 | Hiratsuka et al. |
| 2003/0231179 | A1 | 12/2003 | Suzuki |
| 2004/0047477 | A1 | 3/2004 | Bank et al. |
| 2004/0119770 | A1 | 6/2004 | Tamura |
| 2004/0233241 | A1 | 11/2004 | Salacz |
| 2005/0116977 | A1 | 6/2005 | Shinkawa et al. |
| 2005/0231179 | A1* | 10/2005 | Ishizaki ..... 323/234 |
| 2005/0248399 | A1 | 11/2005 | Kurokawa |
| 2006/0132231 | A1 | 6/2006 | Ishii et al. |
| 2006/0181342 | A1 | 8/2006 | Kanoh |
| 2007/0079710 | A1 | 4/2007 | Ishizaki |
| 2007/0120938 | A1 | 5/2007 | Fitzpatrick et al. |
| 2007/0165074 | A1 | 7/2007 | Ishizaki |
| 2008/0018683 | A1 | 1/2008 | Oshima et al. |
| 2008/0018685 | A1 | 1/2008 | Tabata et al. |
| 2008/0018686 | A1 | 1/2008 | Oshima et al. |
| 2008/0018687 | A1 | 1/2008 | Tabata et al. |
| 2008/0100652 | A1 | 5/2008 | Oshima et al. |
| 2008/0186350 | A1 | 8/2008 | Oshima et al. |
| 2008/0198191 | A1 | 8/2008 | Oshima |
| 2008/0218545 | A1 | 9/2008 | Oshima et al. |
| 2009/0033698 | A1 | 2/2009 | Suzuki et al. |
| 2009/0066739 | A1 | 3/2009 | Tabata et al. |
| 2009/0140780 | A1 | 6/2009 | Miyazaki et al. |
| 2009/0213152 | A1 | 8/2009 | Tabata et al. |
| 2009/0267979 | A1 | 10/2009 | Tabata et al. |
| 2009/0289980 | A1 | 11/2009 | Tabata et al. |
| 2009/0303271 | A1 | 12/2009 | Tabata et al. |
| 2010/0091059 | A1 | 4/2010 | Oshima et al. |
| 2010/0097419 | A1 | 4/2010 | Oshima |
| 2010/0188452 | A1 | 7/2010 | Oshima |
| 2010/0220133 | A1 | 9/2010 | Oshima et al. |
| 2011/0102486 | A1 | 5/2011 | Tabata et al. |
| 2011/0109674 | A1 | 5/2011 | Oshima et al. |

FOREIGN PATENT DOCUMENTS

| | | | |
|---|---|---|---|
| JP | 63-247059 | | 10/1988 |
| JP | 02-262705 | | 10/1990 |
| JP | 03-147446 | A | 6/1991 |
| JP | 05-077456 | | 3/1993 |
| JP | 05-199044 | | 8/1993 |
| JP | 09-234865 | A | 9/1997 |
| JP | 09-300618 | A | 11/1997 |
| JP | 09-308264 | | 11/1997 |
| JP | 10-081013 | | 3/1998 |
| JP | 10-210757 | A | 8/1998 |
| JP | 11-058733 | A | 3/1999 |
| JP | 11-204850 | | 7/1999 |
| JP | 11-204850 | A | 7/1999 |
| JP | 2000-117980 | A | 4/2000 |
| JP | 2000-238262 | | 9/2000 |
| JP | 2000-245162 | | 9/2000 |
| JP | 2001-121697 | | 5/2001 |
| JP | 2001-162794 | A | 6/2001 |
| JP | 2001-268922 | A | 9/2001 |
| JP | 2002-204595 | A | 7/2002 |
| JP | 2002-210958 | A | 7/2002 |
| JP | 2002-536903 | A | 10/2002 |
| JP | 2003-001824 | | 1/2003 |
| JP | 2003-237068 | | 8/2003 |
| JP | 2004-048886 | A | 2/2004 |
| JP | 2004-306434 | | 11/2004 |
| JP | 2004-306434 | A | 11/2004 |
| JP | 2005-035062 | | 2/2005 |
| JP | 2005-065068 | | 3/2005 |
| JP | 2005-075475 | | 3/2005 |
| JP | 2005-131928 | | 5/2005 |
| JP | 2005-322957 | | 11/2005 |
| JP | 2005-329710 | | 12/2005 |
| JP | 2005-349576 | A | 12/2005 |
| JP | 2006-025151 | | 1/2006 |
| JP | 2006-231882 | | 9/2006 |
| JP | 2006-256151 | | 9/2006 |
| JP | 2006-272907 | | 10/2006 |
| JP | 2006-272907 | A | 10/2006 |
| JP | 2007-069555 | | 3/2007 |
| JP | 2007-096364 | | 4/2007 |
| JP | 2007-144867 | | 6/2007 |
| JP | 2007-168172 | | 7/2007 |
| JP | 2007-190708 | | 8/2007 |
| JP | 2008-049698 | | 3/2008 |
| JP | 2008-049699 | | 3/2008 |
| JP | 2008-087467 | | 4/2008 |
| WO | 00/46919 | A2 | 8/2000 |

OTHER PUBLICATIONS

U.S. Appl. No. 12/637,412, filed Dec. 14, 2009, Oshima et al.
U.S. Appl. No. 11/780,301, Mail Date Jun. 27, 2008, Office Action.
U.S. Appl. No. 11/780,301, Mail Date Feb. 20, 2009, Final Office Action.
U.S. Appl. No. 11/780,301, Mail Date Jun. 16, 2009, Notice of Allowance.
U.S. Appl. No. 11/780,357, Mail Date Oct. 28, 2009, Office Action.
U.S. Appl. No. 11/780,390, Mail Date Apr. 8, 2009, Notice of Allowance.
U.S. Appl. No. 11/849,582, Mail Date May 28, 2008, Office Action.
U.S. Appl. No. 11/849,582, Mail Date Dec. 30, 2009, Final Office Action.
U.S. Appl. No. 11/923,448, Mail Date Nov. 27, 2009, Office Action.
U.S. Appl. No. 11/780,357, Mail Date May 12, 2010, Final Office Action.
U.S. Appl. No. 11/849,582, Mail Date Apr. 19, 2010, Notice of Allowance.
U.S. Appl. No. 11/,923,448, Mail Date Apr. 28, 2010, Final Office Action.
U.S. Appl. No. 11/780,379, Mail Date Mar. 3, 2010, Office Action.
U.S. Appl. No. 12/351,472, Mail Date Jan. 4, 2010, Notice of Allowance.
U.S. Appl. No. 12/340,940, Mail Date Apr. 12, 2010, Notice of Allowance.
U.S. Appl. No. 12/161,148, Mail Date Mar. 30, 2010, Office Action.
U.S. Appl. No. 11/780,379, Mail Date Aug. 20, 2010, Final Office Action.
U.S. Appl. No. 12/161,148, Mail Date Sep. 16, 2010, Final Office Action.
U.S. Appl. No. 12/161,201, Mail Date Sep. 28, 2010, Office Action.
U.S. Appl. No. 12/509,915, Mail Date Sep. 20, 2010, Office Action.
U.S. Appl. No. 12/637,412, Mail Date Aug. 23, 2010, Office Action.
U.S. Appl. No. 12/752,367, Mail Date Oct. 8, 2010, Office Action.
Notice of Allowance dated Jun. 14, 2011 as received in related U.S. Appl. No. 12/637,412.
Office Action dated Jun. 14, 2011 as received in related U.S. Appl. No. 12/026,129.
Office Action dated Jun. 15, 2011 as received in related U.S. Appl. No. 12/027,175.

European Search Report dated Jan. 28, 2010 received in European Application No. EP07706915.1.
Office Action dated Mar. 4, 2011 as received in related U.S. Appl. No. 11/780,357.
Office Action dated Mar. 3, 2010 as received in related U.S. Appl. No. 11/780,379.
Office Action dated Mar. 4, 2011 as received in related U.S. Appl. No. 11/780,379.
Office Action dated Dec. 27, 2010 as received in related U.S. Appl. No. 12/026,129.
Office Action dated Dec. 27, 2010 as received in related U.S. Appl. No. 12/027,175.
Office Action dated Aug. 20, 2010 as received in related U.S. Appl. No. 11/780,379.
Notice of Allowance dated Apr. 5, 2010 as received in related U.S. Appl. No. 11/972,542.
Notice of Allowance dated Dec. 17, 2010 as received in related U.S. Appl. No. 12/498,296.
United States Office Action dated Oct. 27, 2011 as received in U.S. Appl. No. 12/158,591.
United States Notice of Allowance dated Nov. 25, 2011 as received in U.S. Appl. No. 12/637,412.
U.S. Office Action dated Oct. 11, 2011 as represented in related U.S. Appl. No. 12/624,206.
Japan Office Action dated Nov. 1, 2011 received in related application No. 2007-181649.
United States Office Action dated Jan. 9, 2012 as received in U.S. Appl. No. 12/389,525.
United States Notice of Allowance dated Jan. 13, 2012 as received in U.S. Appl. No. 12/161,201.
United States Office Action dated Apr. 14, 2011 as received in U.S. Appl. No. 12/161,201.

* cited by examiner

LIQUID JET APPARATUS AND PRINTING APPARATUS

CROSS-REFERENCE TO A RELATED APPLICATION

This application is a Divisional of U.S. patent application Ser. No. 11/780,379 filed Jul. 19, 2007 which claimed priority to Japanese Patent Application Number 2006-200352 filed Jul. 24, 2006 and to Japanese Patent Application Number 2007-184438 filed Jul. 13, 2007. The entire disclosures of these applications are expressly incorporated herein by reference.

BACKGROUND

1. Technical Field

The present invention relates to a liquid jet apparatus and printing apparatus arranged to print predetermined letters and images by emitting microscopic droplets of liquids from a plurality of nozzles to form the microscopic particles (dots) thereof on a printing medium.

2. Related Art

An inkjet printer as one of such printing apparatuses Inkjet printers are generally low-price and provide high quality color prints Inkjet printers are not only used in offices but also used by general users as well in conjunction with the widespread use of personal computers and digital cameras.

In recent inkjet printers, printing in fine tone is required. Tone denotes a state of density of each color included in a pixel expressed by a liquid dot. The size of the dot corresponds to the color density of each pixel and is called a tone grade. The number of tone grades capable of being expressed by a liquid dot is called a tone number. Fine tone denotes that the tone number is large. In order to change the tone grade, it is required to modify a drive pulse to an actuator for a liquid jet head. When a piezoelectric element is used as the actuator, since the amount of displacement of the piezoelectric element (distortion of a diaphragm, to be precise) becomes large when the voltage value applied to the piezoelectric element becomes large, the tone grade of the liquid dot can be changed very accurately.

Therefore, in JP-A-10-81013 a plurality of drive pulses with different wave heights are combined and joined. The drive pulses are commonly output to the piezoelectric elements of the nozzles of the same color provided to the liquid jet head. A drive pulse corresponding to the tone grade of the liquid dot to be formed is selected for every nozzle out of the plurality of drive pulses. The selected drive pulses are supplied to the piezoelectric elements of the corresponding nozzles to emit droplets of the liquid different in amount, thereby achieving the required tone grade of the liquid dot.

The method of generating the drive signals (or the drive pulses) is described in FIG. 2 of JP-A-2004-306434. Specifically, the data is retrieved from a memory storing the data of the drive signal. The data is converted into analog data by a D/A converter, and the drive signal is supplied to the liquid jet head through a voltage amplifier and a current amplifier. The circuit configuration of the current amplifier is, as shown in FIG. 3 of JP-A-2004-306434, composed of push-pull connected transistors, and the drive signal is amplified by a so called linear drive. However, in the current amplifier with such a configuration, the linear drive of the transistor is inefficient, a large-sized transistor is required as a measure against heating of the transistor, and moreover, a heat radiation plate for cooling the transistor is required. Thus, a disadvantage of growth in the circuit size arises, and among others, the size of the heat radiation plate constitutes a great barrier to layout design.

In order to overcome this disadvantage in the inkjet printer described in JP-A-2005-35062, the drive signals are generated by controlling a reference voltage of a DC/DC converter. In this case, since a DC/DC converter with good efficiency is used, the heat radiation unit for cooling can be eliminated. Moreover, since a pulse width modulation (PWM) signal is used, a D/A converter can be configured with a simple low-pass filter. As a result, the circuit size can be reduced.

However, obtaining a preferable waveform of the drive signal for ejecting an ink droplet from the inkjet head creates a problem. More specifically, obtaining a rapid rising or falling waveform is difficult since the DC/DC converter is, by nature, designed to generate a constant voltage in a head drive device of the inkjet printer described in JP-A-2005-35062 using the DC/DC converter described above. Further, there is also a problem that the heat radiation plate is too large to substantially complete the layout, particularly in a line head printer having a large number of nozzles in a head drive device of the inkjet printer described in JP-A-2004-306434 for amplifying the current of an actuator drive signal with a push-pull transistor.

BRIEF SUMMARY OF THE INVENTION

The present includes a liquid jet apparatus and a printing apparatus capable of achieving reduction of leakage of a carrier frequency component and high-speed switching when the number of actuators to be driven is small. The present invention also includes reduction of the switching loss and large current driving when the number of actuators is large, while making a rapid rise and fall of the drive signals to the actuators possible without requiring a cooling unit, such as a heat radiation plate.

A liquid jet apparatus according to the present includes a plurality of nozzles, an actuator connected to each nozzle, and a drive unit that applies a drive signal to the actuator. The drive unit includes a drive waveform signal generation unit that generates a drive waveform signal for controlling the operation of the actuator, a modulator unit that pulse-modulates the drive waveform signal to produce a modulated signal, a digital power amplifier for power-amplifying the modulated signal to produce an amplified signal, a low-pass filter for smoothing the amplified signal and supplying the actuator with the drive signal, and a carrier frequency adjusting unit that adjusts a carrier frequency of the pulse modulation by the modulator unit in accordance with the number of actuators to be driven.

According to the liquid jet apparatus of the present invention, the filter characteristics of the low-pass filter are set to be capable of sufficiently smoothing only the amplified signal, which enables the rapid rise and fall of the drive signal. The drive signal can be efficiently power-amplified using the digital power amplifier with little power loss, and a cooling unit, such as a heat radiation plate, can be eliminated.

Further, by adjusting the carrier frequency of the pulse modulation by the modulator in accordance with the number of actuators to be driven, a reduction of the leakage of the carrier frequency component and a reduction of the switching loss becomes possible.

Further, it is preferable that the carrier frequency adjusting unit raises the carrier frequency of the pulse modulation when the number of actuators to be driven is less than or equal to a threshold amount, and lowers the carrier frequency of the pulse modulation when the number of actuators to be driven is greater than the threshold amount.

According to the liquid jet apparatus described above, the leakage of the carrier frequency component can be reduced when the number of actuators to be driven is small and the switching loss can be reduced when the number of actuators to be driven is large.

Further, a liquid jet apparatus according to the present invention is a liquid jet apparatus including a plurality of nozzles for a liquid jet head. An actuator is connected to each nozzle. A drive unit applies a drive signal to the actuator. The drive unit includes a drive waveform signal generation unit that generates a drive waveform signal for controlling the operation of the actuator, a modulator unit that pulse-modulates the drive waveform signal to produce a modulated signal, a digital power amplifier having a plurality of transistors connected in parallel to a power supply for power-amplifying the modulated signal to produce an amplified signal, a low-pass filter for smoothing the amplified and supplying the actuator with the drive signal, and a number of transistor adjusting units that adjust the number of drive transistors of the digital power amplifier in accordance with the number of actuators to be driven.

According to the liquid jet apparatus of the present invention, the filter characteristics of the low-pass filter are set to be capable of sufficiently smoothing only the amplified signal, and as a result, the rapid rise and fall of the drive signal is possible. The drive signal can efficiently be power-amplified using the digital power amplifier with little power loss, and a cooling unit, such as heat radiation plate, can be eliminated.

Further, by adjusting the number of drive transistors of the digital power amplifier in accordance with the number of actuators to be driven, high-speed switching and large current driving become possible.

Further it is preferable that the number of transistor adjusting units decreases the number of drive transistors when the number of actuators to be driven is less than or equal to a threshold amount, and increases the number of drive transistors when the number of actuators to be driven is greater than the threshold amount.

According to the liquid jet apparatus of the invention described above, the total capacitance of the transistors when the number of actuators to be driven is small is reduced to make high-speed switching possible, and when the number of actuators to be driven is large the drive current is distributed to a plurality of transistors, thus large current driving becomes possible.

Further, the printing apparatus of the invention is preferably a printing apparatus provided with the liquid jet apparatus described above. According to the printing apparatus of the present invention, the filter characteristics of the low-pass filter are set to be capable of sufficiently smoothing the power amplified modified signal component, and the rapid rise and fall of the drive signal to the actuator becomes possible. The drive signal can efficiently be power-amplified using the digital power amplifier with little power loss, and a cooling unit, such as heat radiation plate, can be eliminated. Thus, low power consumption can be achieved with reduced power loss, a plurality of liquid jet head can be disposed with good efficiency, and a reduced size of the printing apparatus can be achieved.

DETAILED DESCRIPTION OF THE PREFERRED EMBODIMENTS

An embodiment will be explained with reference to the drawings, using a printing apparatus for printing letters and images on a print medium by emitting a liquid, as an example of the present invention.

Figure 1A:
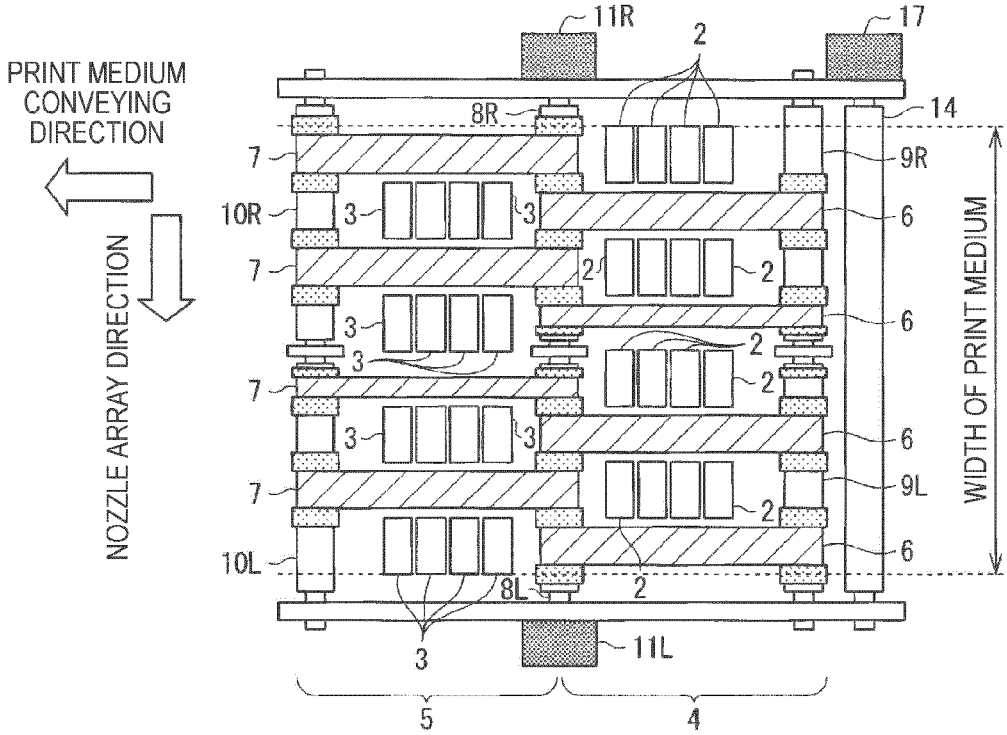
FIG. 1A shows a top view of an overall configuration showing an embodiment of a line head printing apparatus applying the liquid jet apparatus according to the present invention.
Figure 1B:
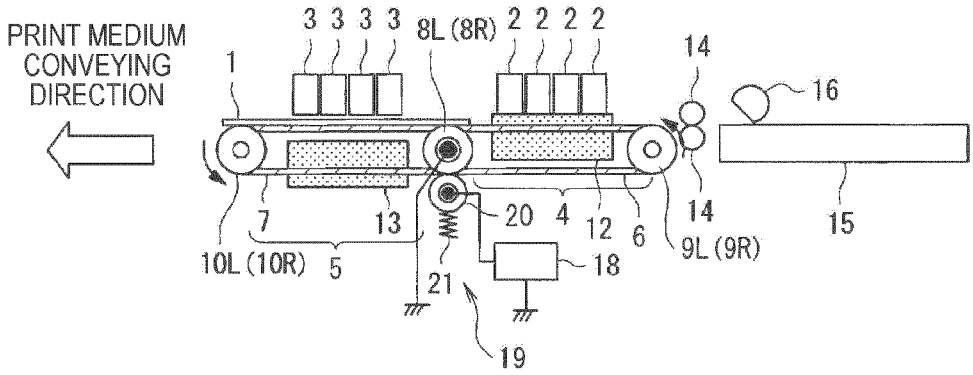
FIG. 1B is a front view of the line head ink jet printer of FIG. 1A.

FIGS. 1A and 1B are schematic configuration views of the printing apparatus according to the present embodiment, wherein FIG. 1A is a top plain view thereof, and FIG. 1B is a front view thereof. In FIG. 1, in the line head printing apparatus, a print medium 1 is conveyed from the upper right to the lower left of the drawing along the arrow direction, and printing occurs in a print area in the middle of the conveying path. It should be noted that the liquid jet heads of the present embodiment are not arranged in one line, but are arranged in two lines.

A first line of liquid jet heads 2 are arranged on the "upstream" side in the direction of conveyance of the print medium 1. A second line of liquid jet heads 3 are arranged on the downstream side. A first conveying section 4 for conveying the print medium 1 is disposed below the first liquid jet head 2, and a second conveying section 5 is disposed below the second liquid jet head 3. The first conveying section 4 is composed of four first conveying belts 6 disposed with predetermined intervals in the direction (hereinafter also referred to as a nozzle array direction) traversing the conveying direction of the print medium 1, the second conveying section 5 is similarly composed of four second conveying belts 7 disposed with predetermined intervals in the nozzle array direction.

The four first conveying belts 6 and the similar four second conveying belts 7 are alternated with respect to each other. In the present embodiment, out of the conveying belts 6 and 7, the two first and second conveying belts 6 and 7 in the right side in the nozzle array direction are distinguished from the two first and second conveying belts 6 and 7 in the left side in the nozzle array direction. In other words, an overlapping portion of two of the first and second conveying belts 6 and 7 in the right side in the nozzle array direction is provided with a right side drive roller 8R, an overlapping portion of two of the first and second conveying belts 6 and 7 in the left side in the nozzle array direction is provided with a left side drive roller 8L, a right side first driven roller 9R and left side first driven roller 9L are disposed on the upstream side thereof, and a right side second driven roller 10R and left side second driven roller 10L are disposed on the downstream side thereof. Although these rollers may appear to be single rollers, they are actually decoupled in the center portion of FIG. 1A.

Further, the two first conveying belts 6 in the right side in the nozzle array direction are wound around the right side drive roller 8R and the right side first driven roller 9R, the two first conveying belts 6 in the left side in the nozzle array direction are wound around the left side drive roller 8L and the left side first driven roller 9L, the two second conveying belts 7 in the right side in the nozzle array direction are wound around the right side drive roller 8R and the right side second driven roller 10R, and the two second conveying belts 7 in the left side in the nozzle array direction are wound around the left side drive roller 8L and the left side second driven roller 10L. Further, a right side electric motor 11R is connected to the right side drive roller 8R, and a left side electric motor 11L is connected to the left side drive roller 8L. Therefore, when the right side electric motor 11R drives the right side drive roller 8R, the first conveying section 4 composed of the two first conveying belts 6 in the right side in the nozzle array direction and similarly the second conveying section 5 composed of the two second conveying belts 7 in the right side in the nozzle array direction move in sync with each other and at the same speed when the left side electric motor 11L drives the left side drive roller 8L, the first conveying section 4 composed of the two first conveying belts 6 in the left side in the nozzle array direction and similarly the second conveying section 5 composed of the two second conveying belts 7 in the left side in the nozzle array direction move in sync with each other and at the same speed.

It should be noted that by arranging the rotational speeds of the right side electric motor 11R and the left side electric motor 11L to be different from each other, the conveying speeds in the left and right in the nozzle direction can be different from each other; specifically, by arranging the rotational speed of the right side electric motor 11R higher than the rotational speed of the left side electric motor 11L, the conveying speed in the right side in the nozzle array direction can be made higher than that in the left side, and by arranging the rotational speed of the left side electric motor 11L higher than the rotational speed of the right side electric motor 11R, the conveying speed in the left side in the nozzle array direction can be made higher than that in the right side.

The first liquid jet heads 2 and the second liquid jet heads 3 include a set of colors, yellow (Y), magenta (M), cyan (C), and black (K) shifted in the conveying direction of the print medium 1. The liquid jet heads 2 and 3 are supplied with liquids from liquid tanks (not shown) of their respective colors via liquid supply tubes (not shown). Each of the liquid jet heads 2 and 3 is provided with a plurality of nozzles formed in the nozzle array direction and by emitting the necessary amount of liquid jet from the respective nozzles simultaneously to the necessary positions microscopic liquid dots are formed on the print medium 1. By performing the process described above by the set of colors, one-pass print can be achieved by making the print medium 1 conveyed by the first and second conveying sections 4 and 5 pass therethrough once. In other words, the area in which the liquid jet heads 2 and 3 are disposed corresponds to the print area.

As a method of emitting liquid jets from each of the nozzles of the liquid jet heads, an electrostatic method, a piezoelectric method, a film boiling jet method and so on, can be explained. In the electrostatic method, when a drive signal is provided to an electrostatic gap as an actuator, a diaphragm in the cavity is displaced to cause pressure variation in the cavity, and the liquid is emitted from the nozzle in accordance with the pressure variation. In the piezoelectric method, when a drive signal is provided to a piezoelectric element as an actuator, a diaphragm in the cavity is displaced to cause pressure variation in the cavity, and the liquid is emitted from the nozzle in accordance with the pressure variation. In the film boiling jet method, a microscopic heater is provided in the cavity, and is instantaneously heated to be at a temperature higher than 300° C. to make the liquid enter the boiling state to generate a bubble, thus causing a pressure variation and making the liquid be emitted from the nozzle. The present invention can apply to any of the above liquid jet methods, and among others, the invention is particularly suitable for the piezoelectric element, capable of adjusting an amount of the liquid jet by controlling the wave height and/or gradient of the increase or decrease in the voltage of the drive signal.

The liquid jet nozzles of the first liquid jet heads 2 are provided between the four first conveying belts 6 of the first conveying section 4, and the liquid jet nozzles of the second liquid jet heads 3 are provided between the four second conveying belts 7 of the second conveying section 5. Although this is for cleaning each of the liquid jet heads 2 and 3 with a cleaning section described later, the entire surface is not printed by one-pass printing if either one of the liquid jet heads is used independently. Therefore, the first liquid jet heads 2 and the second liquid jet heads 3 are disposed alternately in the conveying direction of the print head 1 in order to compensate for each other's unprintable areas.

Disposed below the first liquid jet heads 2 is a first cleaning cap 12 for cleaning the first liquid jet heads 2, and disposed below the second liquid jet heads 3 is a second cleaning cap 13 for cleaning the second liquid jet head 3. Each of the cleaning caps 12 and 13 is formed to allow the cleaning caps to pass between the four first conveying belts 6 of the first conveying section 4 and between the four second conveying belts 7 of the second conveying section 5. Each of the cleaning caps 12 and 13 is composed of a cap body having a rectangular shape with a top, covering the nozzles provided on the lower surface, namely the nozzle surface of the liquid jet heads 2 and 3, and capable of adhering to the nozzle surface, a liquid absorbing body disposed at the bottom of the cap body, a peristaltic pump connected to the bottom of the cap body, and an elevating device for moving the cap body up and down. The cap body is moved up by the elevating device to be adhered to the nozzle surface of the liquid jet heads 2 and 3. By causing negative pressure in the cap body using the peristaltic pump in the present state, the liquid and bubbles are suctioned from the nozzle openings on the nozzle surface of the liquid jet heads 2 and 3, thus the cleaning of the liquid jet heads 2 and 3 can be performed. After the cleaning is completed, each of the cleaning caps 12 and 13 is moved down.

On the upstream side of the first driven rollers 9R and 9L, there are provided a pair of gate rollers 14 for adjusting the feed timing of the print medium 1 from a feeder section 15 and at the same time correcting the skew of the print medium 1. The skew denotes a rotation of the print medium 1 with respect to the conveying direction. Further, above the feeder section 15, there is provided a pickup roller 16 for feeding the print medium 1. A gate roller motor 17 drives the gate rollers 14.

A belt charging device 19 is disposed below the drive rollers 8R and 8L. The belt charging device 19 is composed of a charging roller 20 having a contact with the first conveying belts 6 and the second conveying belts 7 via the drive rollers 8R and 8L, a spring 21 for pressing the charging roller 20 against the first conveying belts 6 and the second conveying belts 7, and a power supply 18 for providing charge to the charging roller 20. The belt charging device 19 charges the first conveying belts 6 and the second conveying belts 7 by providing them with the charge from the charging roller 20. Since the belts are generally made of a moderate or high resistivity material or an insulating material, when the they are charged by the belt charging device 19, the charge applied on the surface thereof causes the print medium 1, made similarly of a high resistivity material or an insulating material, to achieve dielectric polarization, and the print medium 1 can be adhered to the belt by the electrostatic force caused between the charge generated by the dielectric polarization and the charge on the surface of the belt. It should be noted that as the belt charging device 19, a corotron for showering charge can also be used.

Therefore, according to the present printing apparatus, when the surfaces of the first conveying belts 6 and the second conveying belts 7 are charged by the belt charging device 19, the print medium 1 is fed from the gate roller 14, and the print medium 1 is pressed against the first conveying belts 6 by a sheet pressing roller composed of a spur or a roller (not shown), the print medium 1 is adhered to the surfaces of the first conveying belts 6 under the action of dielectric polarization. When the electric motors 11R and 11L drive the drive rollers 8R and 8L, the drive force is transmitted to the first driven rollers 9R and 9L via the first conveying belts 6.

Thus, the first conveying belts 6 are moved to the downstream side of the conveying direction while adhering to the print medium 1, printing is performed by emitting liquid from the nozzles formed on the first liquid jet heads 2 while moving the print medium 1 below the first liquid jet heads 2. When the printing by the first liquid jet heads 2 is complete, the print medium 1 is moved to the downstream side of the conveying direction to be switched to the second conveying belts 7 of the second conveying section 5. As described above, since the second conveying belts 7 are also provided with the charge on the surface thereof by the belt charging device 19, the print medium 1 is adhered to the surfaces of the second conveying belts 7 under the action of the dielectric polarization.

The second conveying belts 7 are moved to the downstream side of the conveying direction, printing is performed by emitting liquid from the nozzles formed on the second liquid jet heads 3 while moving the print medium 1 below the second liquid jet heads 3. After printing by the second liquid jet heads 3 is complete, the print medium 1 is moved further to the downstream side of the conveying direction, the print medium 1 is ejected to a catch tray while separating it from the surfaces of the second conveying belts 7 by a separating device (not shown).

When cleaning of the first and second liquid ejection heads 2 and 3 becomes necessary, as described above, the first and second cleaning caps 12 and 13 are raised to be adhered to the nozzle surfaces of the first and second liquid jet heads 2 and 3, the cleaning is performed by applying negative pressure to the inside of the caps to suction ink droplets and bubbles from the nozzles of the first and second liquid jet heads 2 and 3, and then, the first and second cleaning caps 12 and 13 are moved down.

Figure 2:
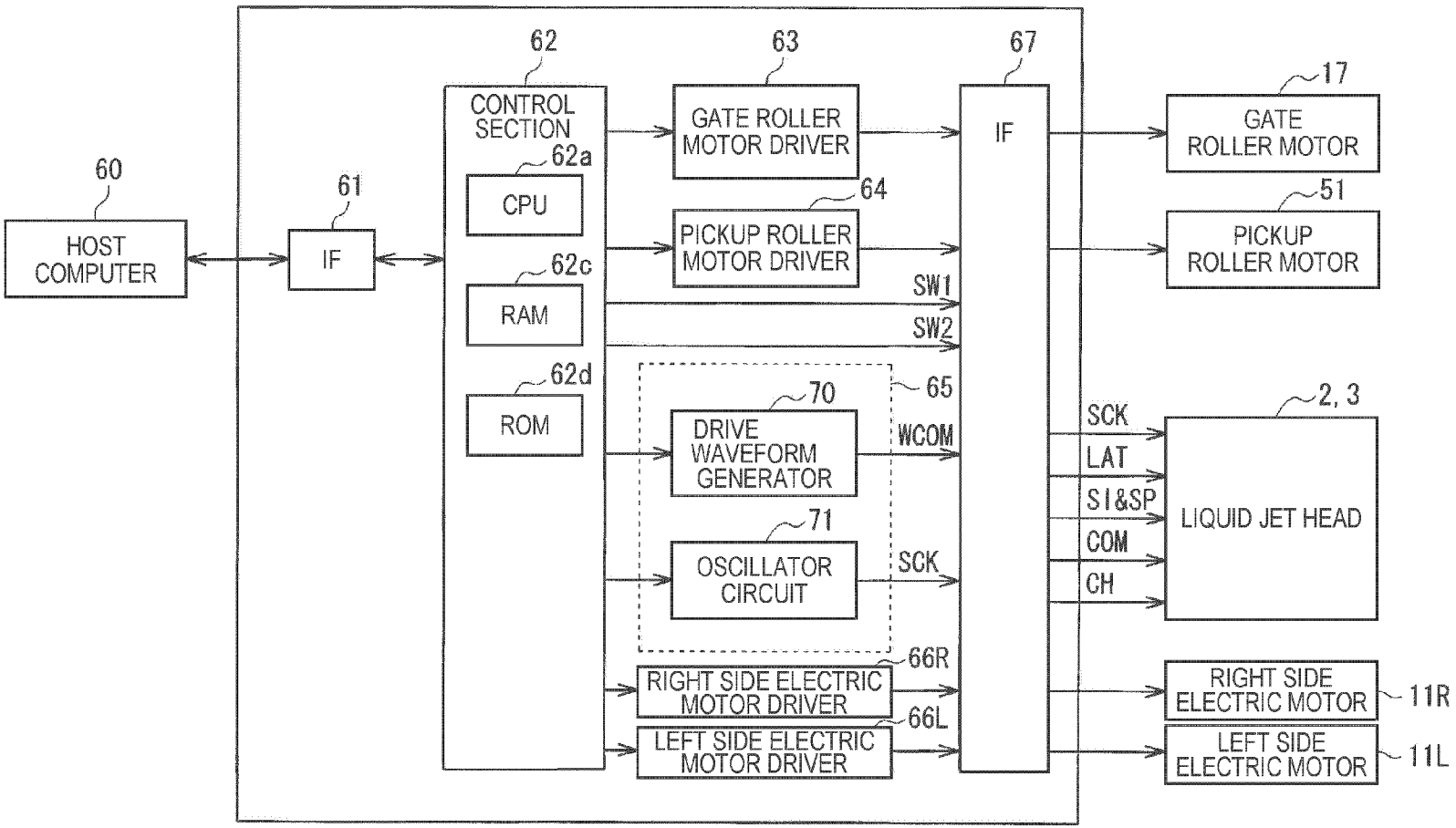
FIG. 2 is a block diagram of a control device of the printing apparatus shown in FIG. 1.

Inside the printing apparatus there is provided a control device for controlling the apparatus itself. The control device is, as shown in FIG. 2, for controlling the printing apparatus, the feeder device, and so on, based on print data input from a host computer 60, such as a personal computer or a digital camera, thereby performing the print process on the print medium 1. Further, the control device includes an input interface section 61 for receiving print data input from the host computer 60, a control section 62 formed of a microcomputer for performing the print process based on the print data input from the input interface section 61, a gate roller motor driver 63 for driving the gate roller motor 17, a pickup roller motor driver 64 for driving a pickup roller motor 51 for driving the pickup roller 16, a head driver 65 for driving the liquid jet heads 2 and 3, a right side electric motor driver 66R for driving the right side electric motor 11R, a left side electric motor driver 66L for driving the left side electric motor 11L, and an interface 67 for converting the output signals of the drivers 63, 64, 65, 66R, and 66L into drive signals used in the gate roller motor 17, the pickup roller motor 51, the liquid jet heads 2 and 3, the right side electric motor 11R, and the left side electric motor 11L.

The control section 62 is provided with a central processing unit (CPU) 62*a* for performing various processes, such as the print process, a random access memory (RAM) 62*c* for temporarily storing the print data input via the input interface 61 and various kinds of data used in performing the print process of the print data, and for temporarily developing an application program, such as for the print process, and a read-only memory (ROM) 62*d* formed of a nonvolatile semiconductor memory and for storing the control program executed by the CPU 62*a* and so on. When the control section 62 receives the print data (image data) from the host computer 60 via the interface section 61, the CPU 62*a* performs a predetermined process on the print data to output printing data (drive pulse selection data SI & SP) regarding which nozzle emits the liquid and/or how much liquid is emitted, and further outputs the control signals to the respective drivers 63, 64, 65, 66R, and 66L based on the printing data and the input data from the various sensors. When the control signals are output from the respective drivers 63, 64, 65, 66R, and 66L, the control signals are converted by the interface section 67 into the drive signals, the actuators corresponding to a plurality of nozzles of the liquid jet heads 2 and 3, the gate roller motor 17, the pickup roller motor 51, the right side electric motor 11R, and the left side electric motor 11L respectively operate, thus the feeding and conveying the print medium 1, posture control of the print medium 1, and the print process to the print medium 1 are performed. Further, the control section 62 outputs switch drive signals swp1, swn1, swp2, and swn2 to a digital power amplifier of a drive signal output circuit, described later, disposed inside the interface section 67 to switch on and off a plurality of MOSFETs in the digital power amplifier. It should be noted that the elements inside the control section 62 are electrically connected to each other via a bus (not shown).

In order to write the waveform forming data DATA for forming the drive signal described later in a waveform memory 701, the control section 62 outputs a write enable signal DEN, a write clock signal WCLK, and write address data A0 through A3 to write the 16 bit waveform forming data DATA into the waveform memory 701, and further, outputs the read address data A0 through A3 for reading the waveform forming data DATA stored in the waveform memory 701, a first clock signal ACLK for setting the timing for latching the waveform forming data DATA retrieved from the waveform memory 701, a second clock signal BCLK for setting the timing for adding the latched waveform data, and a clear signal CLER for clearing the latched data to the head driver 65.

Figure 3:
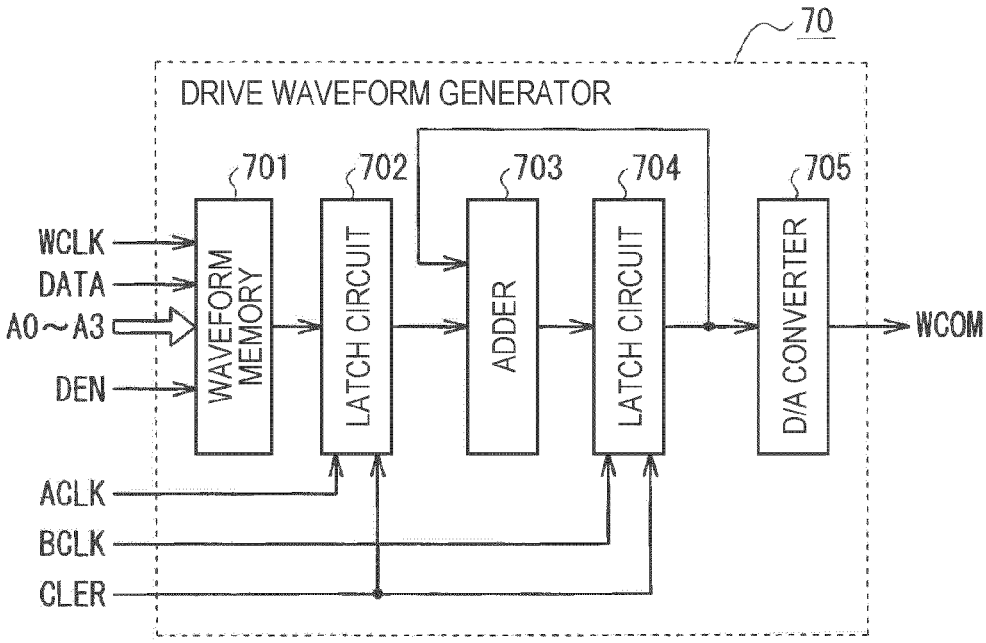
FIG. 3 is a block configuration diagram of the drive waveform signal generation circuit shown in FIG. 2.

The head driver 65 is provided with a drive waveform generator 70 for forming the drive waveform signal WCOM and an oscillator circuit 71 for outputting a clock signal SCK. The drive waveform generator 70 is provided, as shown in FIG. 3, with waveform memory 701 for storing the waveform forming data DATA input from the control section 62 in the storage element corresponding to a predetermined address, a latch circuit 702 for latching the waveform forming data DATA retrieved from the waveform memory 701 in accordance with the first clock signal ACLK described above, an adder 703 for adding the output of the latch circuit 702 with the waveform generation data WDATA output from a latch circuit 704 described later, the latch circuit 704 for latching the added output of the adder 703 in accordance with the second clock signal BCLK, and a D/A converter 705 for converting the waveform generation data WDATA output from the latch circuit 704 into an analog signal. The clear signal CLER output from the control section 62 is input to the latch circuits 702 and 704, and when the clear signal CLER is in the off state, the latched data is cleared.

Figure 4:
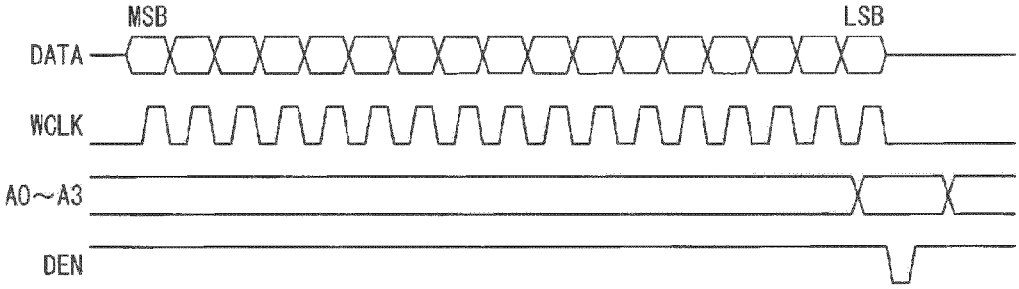
FIG. 4 is an explanatory diagram of the waveform memory shown in FIG. 3.

The waveform memory 701 is provided, as shown in FIG. 4, with several bits of memory elements arranged in each designated address, and the waveform data DATA is stored together with the address A0 through A3. Specifically, the waveform data DATA is input in accordance with the clock signal WCLK with respect to the address A0 through A3 designated by the control section 62, and the waveform data DATA is stored in the memory elements in response to input of the write enable signal DEN.

The principle of generating the drive waveform signal by the drive waveform generator 70 will now be explained. First, in the address A0 there is written the waveform data of zero as an amount of voltage variation per unit time period. Similarly, the waveform data of +ΔV1 is written in the address A1, the waveform data of −ΔV2 is written in the address A2, and the waveform data of +ΔV3 is written in the address A3. Further, the stored data in the latch circuits 702 and 704 is cleared by the clear signal CLER. Further, the drive waveform signal WCOM is raised to an intermediate voltage potential (offset) by the waveform data.

Figure 5:
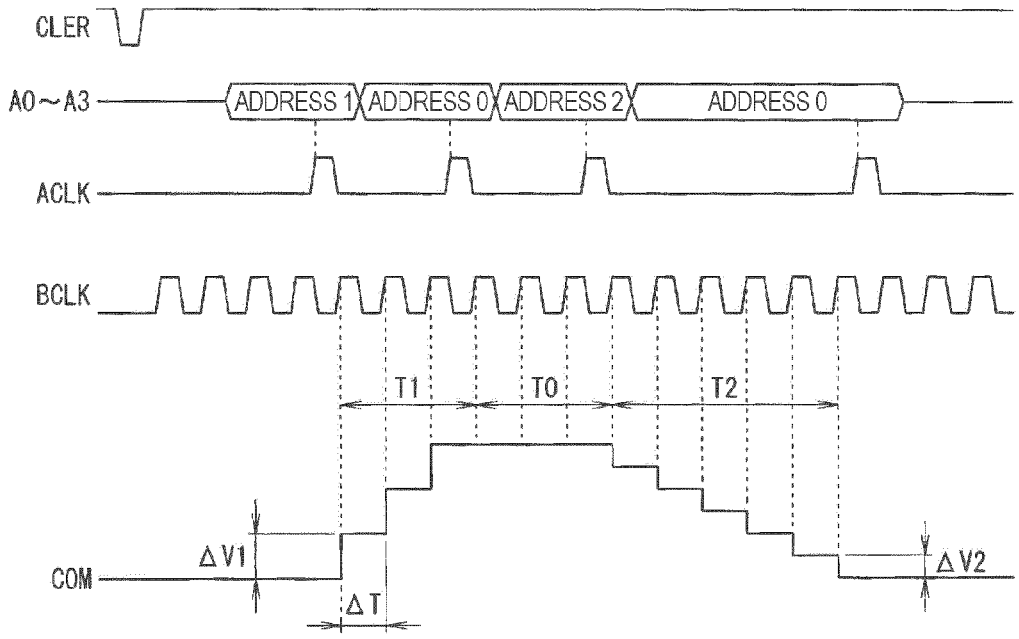
FIG. 5 is an explanatory diagram of generation of the drive waveform signal.

When the waveform data in the address A1 is retrieved, as shown in FIG. 5, for example, and the first clock signal ACLK is input, the digital data of +ΔV1 is stored in the latch circuit 702. The stored digital data of +ΔV1 is input to the latch circuit 704 via the adder 703, and in the latch circuit 704, the output of the adder 703 is stored in sync with the rising of the second clock signal BCLK. Since the output of the latch circuit 704 is also input to the adder 703, the output of the latch circuit 704, namely the drive signal COM is added with +ΔV1 with every rising of the second clock signal BCLK. In the present example, the waveform data in the address of A1 is retrieved for a time interval of T1, and as a result, the digital data of +ΔV1 is tripled.

Subsequently, when the waveform data in the address A0 is retrieved, and in addition, the first clock signal ACLK is input, the digital data stored in the latch circuit 702 is switched to zero. Although this digital data of zero is, similarly to the case described above, added through the adder 703 with the rising timing of the second clock signal BCLK, since the digital data is zero, the previous value is maintained. In the present example, the drive signal COM is maintained at a constant value for the time period of T0.

Subsequently, when the waveform data in the address A2 is retrieved, and in addition, the first clock signal ACLK is input, the digital data stored in the latch circuit 702 is switched to −ΔV2. Although the digital data of −ΔV2 is, similarly to the case described above, added through the adder 703 on the rising edge of the second clock signal BCLK, since the digital data is −ΔV2, the drive signal COM is actually subtracted by −ΔV2 in accordance with the second clock signal. In the present embodiment, the digital data is subtracted for the time period of T2 until the digital data becomes six times as large as −ΔV2.

Figure 6:
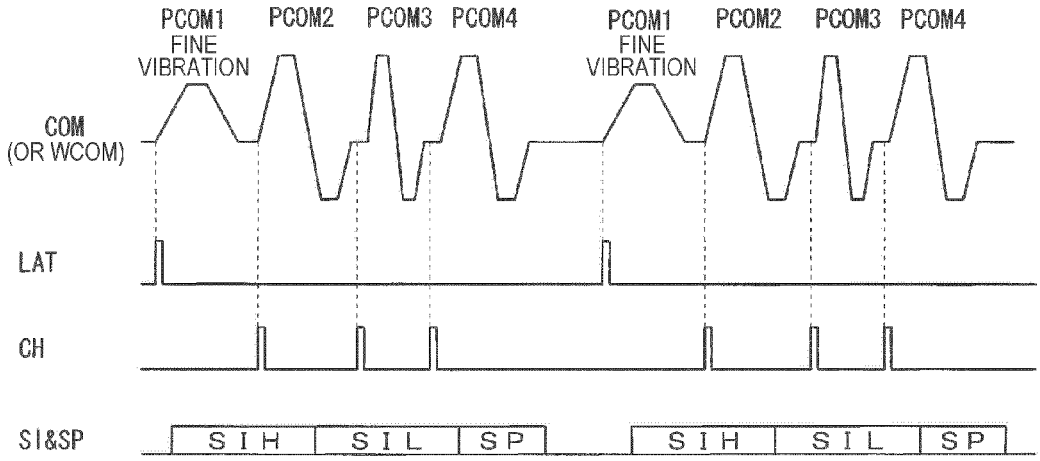
FIG. 6 is an explanatory diagram of the drive waveform signal or the drive signal connected in a time-series manner.
Figure 7:
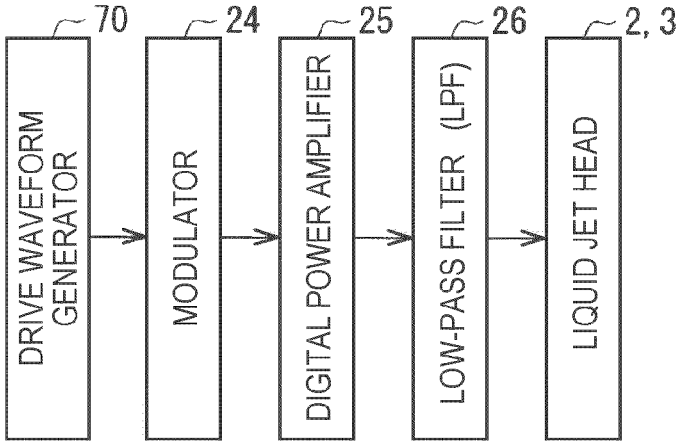
FIG. 7 is a block configuration diagram of a drive signal output circuit.

By performing the analog conversion by the D/A converter 705 on the digital signal thus generated, the drive waveform signal WCOM as shown in FIG. 6 can be obtained. By performing the power amplification by the drive signal output circuit shown in FIG. 7 on the above signal, and supplying it to the liquid jet heads 2 and 3 as the drive signal COM, it becomes possible to drive the actuator provided at each of the nozzles, thus the liquid can be emitted from each of the nozzles. The drive signal output circuit includes a modulator 24 for performing the pulse width modulation on the drive waveform signal WCOM generated by the drive waveform generator 70, a digital power amplifier 25 for performing the power amplification on the modulated (PWM) signal, and a low-pass filter 26 for smoothing the amplified signal.

The rising portion of the drive signal COM corresponds to the stage of expanding the capacity of the cavity (pressure chamber) communicating the nozzle to pull in the liquid (it can be said that the meniscus is pulled in considering the emission surface of the liquid), and the falling portion of the drive signal COM corresponding to the stage of reducing the capacity of the cavity to push out the liquid (it can be said that the meniscus is pushed out considering the emission surface of the liquid), as the result of pushing out the liquid, the liquid is emitted from the nozzle. The series of waveform signals from pulling in the liquid to pushing out the liquid according to the print dot form the drive pulse, and the drive signal COM is formed by linking a plurality of drive pulses. The waveform of the drive signal COM or of the drive waveform signal WCOM can be, as easily inferred from the above description, adjusted by the waveform data 0, +ΔV1, −ΔV2, and +ΔV3 stored in the addresses A0 through A3, the first clock signal ACLK and the second clock signal BCLK. Further, although the first clock signal ACLK is called a clock signal for the sake of convenience, actually, an arithmetic process described later can freely adjust the output timing of the signal.

By variously changing the slope of the increase and the decrease in the voltage and the height of the drive signal COM formed of trapezoidal voltage waves, the pull-in amount and the pull-in speed of the liquid, and the push-out amount and the push-out speed of the liquid can be changed, therefore, the amount of liquid jet emission can be changed to obtain a different size of the liquid dot. Therefore, as shown in FIG. 6, when a plurality of drive pulses are sequentially joined to form the drive signal COM, it is possible that the single drive pulse is selected from such drive pulses to supply to the actuator to emit the liquid jet, or a plurality of drive pulses are selected and supplied to the actuator to emit the liquid jet a plurality of times, thus liquid dots with various sizes can be obtained. In other words, when a number of liquid droplets land on the same position while the liquid is not yet dry, it creates substantially the same result as emitting a larger droplet of the liquid, thus the size of the liquid dot can be enlarged. By combination of such technologies fine tone printing can be achieved. It should be noted that the drive pulse shown in the left end of FIG. 6 is only for pulling in the liquid without pushing out the liquid. This is called a fine vibration, and is used for preventing the nozzle from drying when not emitting the liquid jet.

As a result of the above, the liquid jet heads 2 and 3 are provided with the drive signal COM generated by the drive signal output circuit, the drive pulse selection data SI & SP for selecting the nozzle emitting the liquid jet and determining the connection timing of the actuator to the drive signal COM based on the print data, the latch signal LAT and a channel signal CH for connecting the drive signal COM and the actuator of the liquid jet heads 2 and 3 based on the drive pulse selection data SI & SP after the nozzle selection data is input to all of the nozzles, and the clock signal SCK for transmitting the drive pulse selection data SI & SP to the liquid jet heads 2 and 3 as a serial signal input thereto. It should be noted that hereinafter, when a plurality of drive signals COM are joined and output in a time-series manner, a single drive signal COM is described as the drive pulse PCOM, and the whole signal obtained by joining the drive pulse PCOM in a time-series manner is described as the drive signal COM.

Figure 8:
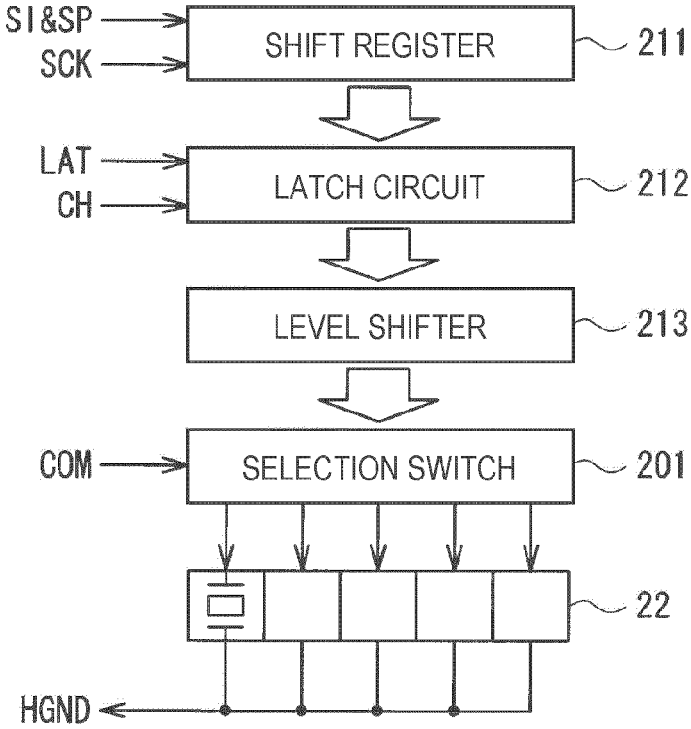
FIG. 8 is a block diagram of a selection section for connecting the drive signal to an actuator.

The configuration of connecting the drive signals COM output from the drive signal output circuit to the actuator will now be explained. FIG. 8 is a block diagram of the selection section for connecting the drive signals COM to the actuators 22, such as a piezoelectric element. The selection section is composed of a shift register 211 for storing the drive pulse selection data SI & SP for designating the actuator 22, such as a piezoelectric element, corresponding to the nozzle from which the liquid jet is to be emitted, a latch circuit 212 for temporarily storing the data of the shift register 211, a level shifter 213 for performing level conversion on the output of the latch circuit 212, and a selection switch 201 for connecting the drive signal COM to the actuator 22, such as a piezoelectric element, in accordance with the output of the level shifter.

The drive pulse selection data SI & SP is sequentially input to the shift register 211, and at the same time, the storage area is sequentially shifted from the first stage to the subsequent stage in accordance with the input pulse of the clock signal SCK. The latch circuit 212 latches the output signals of the shift register 211 in accordance with the input latch signal LAT after the drive pulse selection data SI & SP corresponding to the number of nozzles is stored in the shift register 211. The signals stored in the latch circuit 212 are converted into a voltage level capable of switching on and off the selection switch 201 on the subsequent stage by the level shifter 213. This is because the drive signal COM has a high voltage compared to the output voltage of the latch circuit 212, and the operating voltage range of the selection switch 201 is also set higher accordingly. Therefore, the actuator 22, such as piezoelectric element, the selection switch 201 of which is closed by the level shifter 213 is connected to the drive signal COM with the connection timing of the drive pulse selection data SI & SP. After the drive pulse selection data SI & SP of the shift register 211 is stored in the latch circuit 212, the subsequent drive pulse selection data SI & SP is input to the shift register 211, and the stored data of the latch circuit 212 is sequentially updated with the liquid jet emission timing. It should be noted that the reference HGND in the drawings denotes the ground terminal for the actuator 22, such as the piezoelectric element. Further, according to the selection switch 201, even after the actuator 22, such as the piezoelectric element, is separated from the drive signal COM, the input voltage of the actuator 22 is maintained at the voltage immediately before separation.

Figure 9:
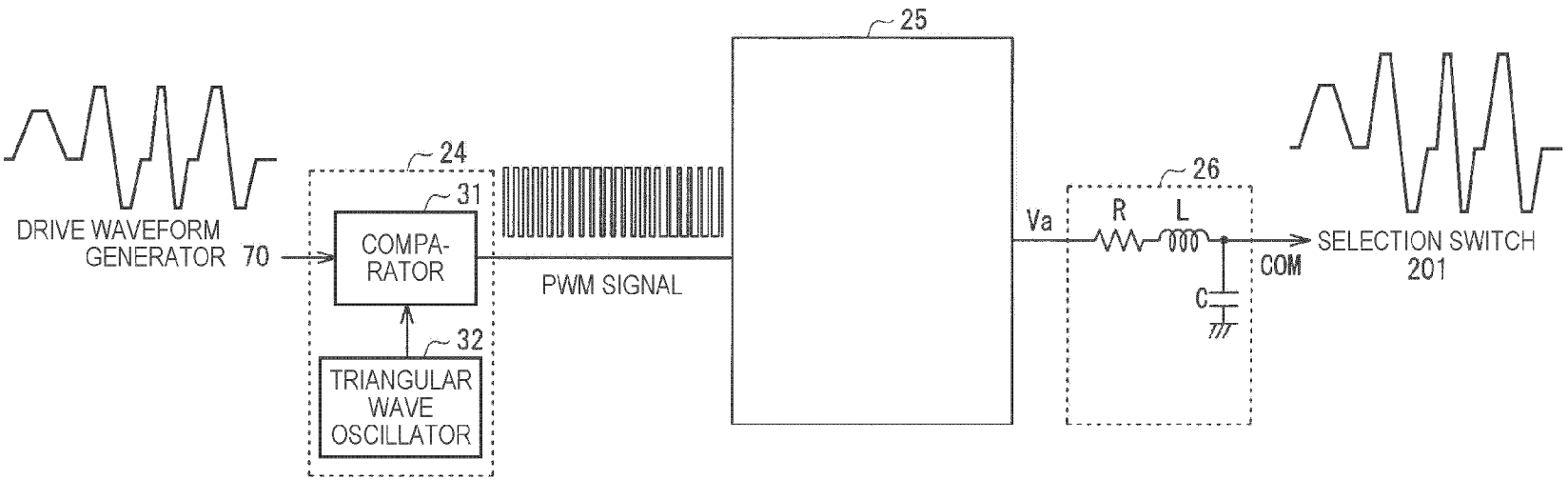
FIG. 9 is a block diagram showing details of the modulation circuit, the digital power amplifier, and the low-pass filter of the drive signal output circuit shown in FIG. 7.
Figure 10:
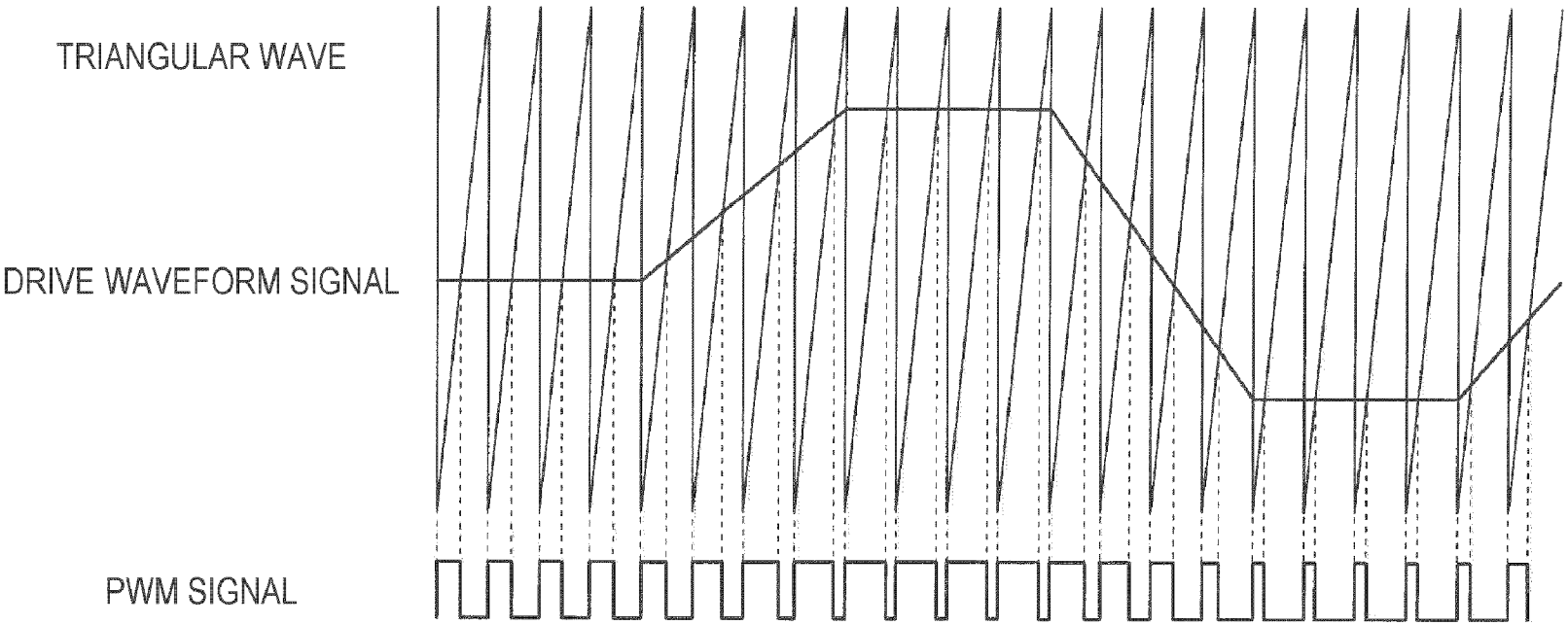
FIG. 10 is an explanatory diagram of the operation of the modulator shown in FIG. 9.

FIG. 9 shows a specific configuration of the modulator 24 of the drive signal output circuit described above to the low-pass filter 26. As the modulator 24 for performing the pulse width modulating on the drive waveform signal WCOM, a common pulse width modulation (PWM) circuit is used. The modulator 24 is composed of a well known triangular wave oscillator 32, and a comparator 31 for comparing the triangular wave output from the triangular wave oscillator 32 with the drive waveform signal WCOM. According to the modulator 24, as shown in FIG. 10, the modulated (PWM) signal is set to HIGH when the drive waveform signal WCOM is higher than the triangular wave, and is set to LOW when the drive waveform signal WCOM is lower than the triangular wave. It should be noted that in the present embodiment, it is contemplated that the carrier frequency of the modulated (PWM) signal can be adjusted by making the period of the triangular wave of the triangular wave oscillator 32 variable.

Figure 11:
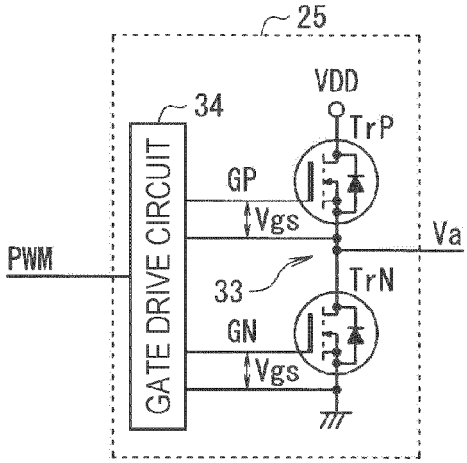
FIG. 11 is a block diagram of the digital power amplifier with only one stage of half-bridge driver stage.
Figure 12:
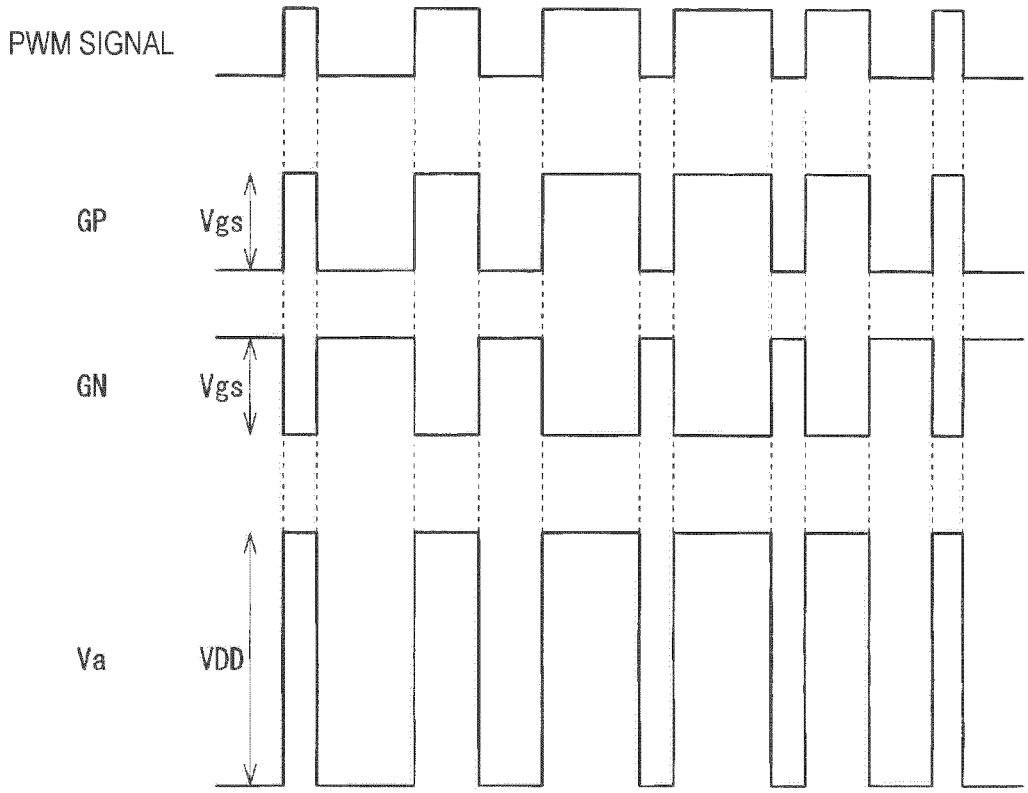
FIG. 12 is an explanatory diagram of the operation of the digital power amplifier shown in FIG. 11.

The operation of the digital power amplifier 25 will be explained using the digital power amplifier 25 shown in FIG. 11, which is provided with only one stage of the half-bridge driver stage 33 to the supply power VDD. The digital power amplifier 25 is configured including a half-bridge driver stage 33 composed of a MOSFET TrP and TrN for substantially amplifying the power, and a gate drive circuit 34 for controlling the gate-source signals GP and GN of the MOSFET TrP and TrN based on the modulated (PWM) signal from the modulator 24, and the half-bridge driver stage 33 is formed by combining the high-side MOSFET TrP and the low-side MOSFET TrN in a push-pull manner. Assuming that the gate-source signal of the high-side MOSFET TrP is GP, the gate-source signal of the low-side MOSFET TrN is GN, and the output of the half-bridge driver stage 33 is Va, FIG. 12 shows how these signals vary in accordance with the modulated (PWM) signal. It should be noted that the voltage values Vgs of the gate-source signals GP and GN of the respective MOSFET TrP and TrN are assumed to be sufficient to turn on the MOSFET TrP and TrN.

When the modulated (PWM) signal is in the HIGH level, the gate-source signal GP of the high-side MOSFET TrP becomes the HIGH level while the gate-source signal GN of the low-side MOSFET TrN becomes the LOW level, the high-side MOSFET TrP becomes the ON state while the low-side MOSFET TrN becomes the OFF state, and as a result, the output Va of the half-bridge driver state 33 becomes the supply voltage VDD. On the other hand, when the modulated (PWM) signal is in the LOW level, the gate-source signal GP of the high-side MOSFET TrP becomes the LOW level while the gate-source signal GN of the low-side MOSFET TrN becomes the HIGH level, the high-side MOSFET TrP becomes the OFF state while the low-side MOSFET TrN becomes the ON state, and as a result, the output Va of the half-bridge driver state 33 becomes zero.

The output Va of the half-bridge driver stage 33 of the digital power amplifier 25 is supplied to the selection switch 201 as the drive signal COM via the low-pass filter 26. The low-pass filter 26 is composed of the combination of a resistor R, an inductance L, and a capacitance C. The low-pass filter 26 is designed to sufficiently attenuate the high frequency component of the output Va of the half-bridge driver stage 33 of the digital power amplifier 25, namely the power amplified modulated (PWM) signal component, and at the same time, not to attenuate the drive signal component COM (or alternatively, the drive waveform component WCOM).

As described above, when the MOSFET TrP and TrN of the digital power amplifier 25 are driven in a digital manner, since the MOSFET acts as a switch element, although the current flows in the MOSFET in the ON state, the drain-source resistance is extremely small and the power loss is small. Further, since no current flows in the MOSFET in the OFF state no power loss occurs. Therefore, the power loss of the digital power amplifier 25 is extremely small, a small-sized MOSFET can be used, and a cooling unit, such as a heat radiation plate, can be eliminated. Incidentally, the efficiency when the transistor is driven in the linear range is about 30% while the efficiency of a digital power amplifier is higher than 90%. Further, since the heat radiation plate for cooling the transistor is about 60 mm square in size for each transistor, if such a radiation plate can be eliminated, an overwhelming advantage in the actual layout can be obtained.

Figure 13:
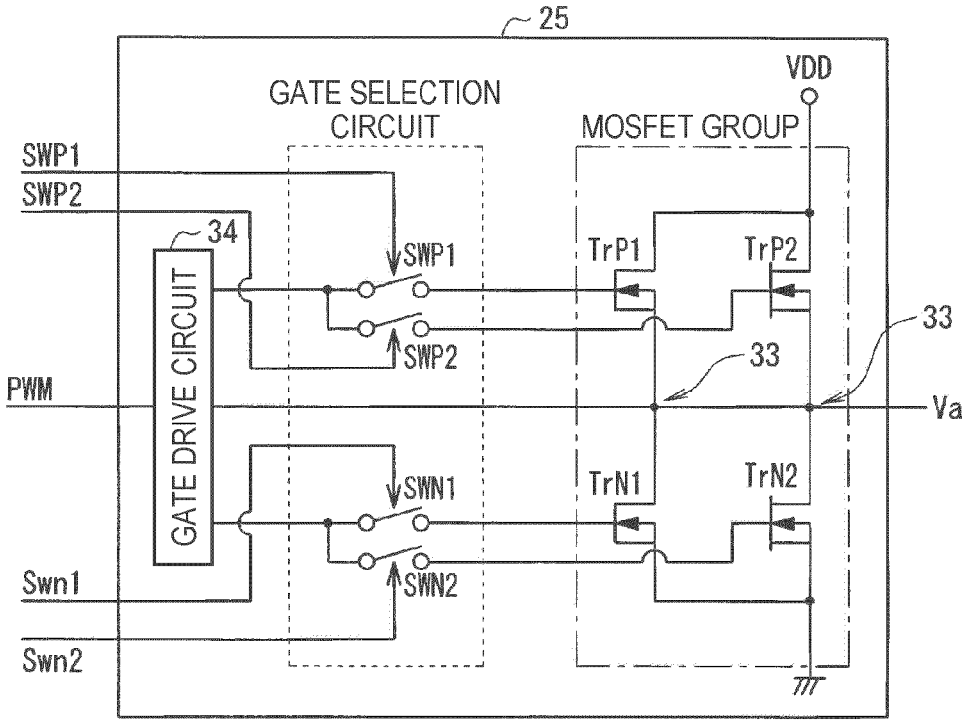
FIG. 13 is a block diagram showing details of the digital power amplifier shown in FIG. 9.

The basic operation of the digital power amplifier is as explained hereinabove. In addition, in the present embodiment, as shown in FIG. 13, the half-bridge driver stages 33 connected in parallel with each other are used with respect to the supply power VDD. The transistors are denoted, from the near side of the gate drive circuit 34, with a first high-side MOSFET TrP1, a first low-side MOSFET TrN1, a second high-side MOSFET TrP2, and a second low-side MOSFET TrN2. It should be noted that the transistors MOSFET TrP1, MOSFET TrN1, MOSFET TrP2, and MOSFET TrN2 are respectively provided with switches SWP1, SWN1, SWP2, and SWN2 for connecting/disconnecting the gate-source signals, which are opened and closed by the control section 62 described above with switch drive signals swp1, swn1, swp2, and swn2, respectively. Further, in the present embodiment, assuming that the gate capacitance of each of the first high-side MOSFET TrP1 and the first low-side MOSFET TrN1 is Qg, the gate capacitance of each of the second high-side MOSFET TrP2 and the second low-side MOSFET TrN2 becomes 2Qg.

Figure 14:
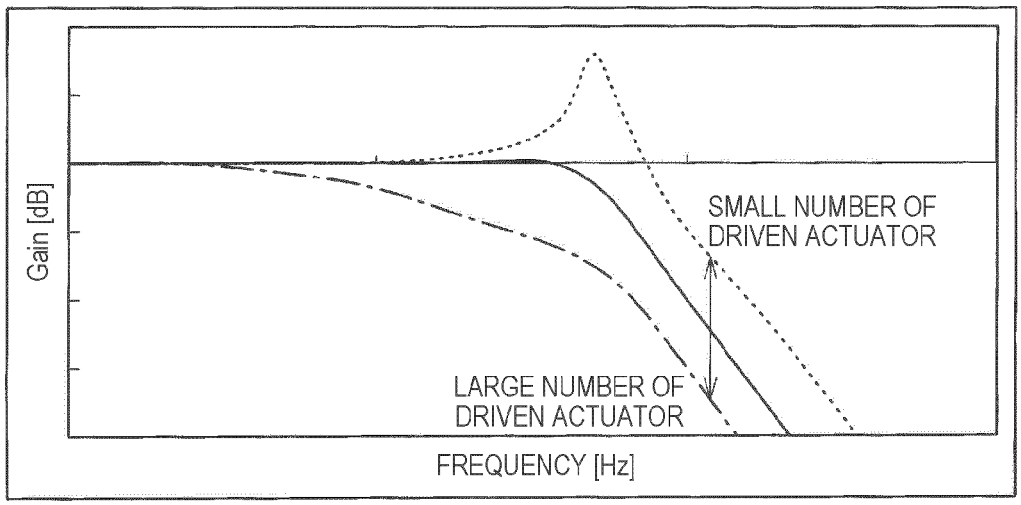
FIG. 14 is a frequency characteristic chart of the drive signal output circuit when the number of drive actuators is varied.
Figure 15A:
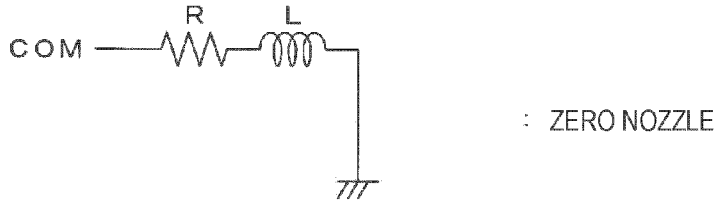
FIG. 15A show a diagram of the low-pass filter without a connected actuator.
Figure 15B:
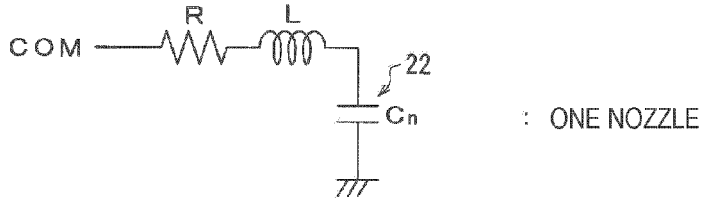
FIG. 15B show a diagram of the low-pass filter with one connected actuator.
Figure 15C:
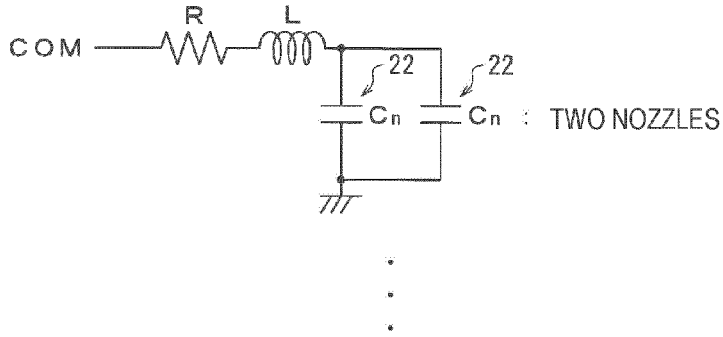
FIG. 15C show a diagram of the low-pass filter with two connected actuators.
Figure 15D:
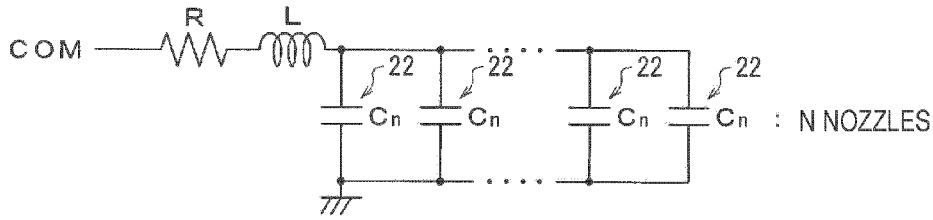
FIG. 15D show a diagram of the low-pass filter with N connected actuators.

The switch drive signals swp1, swn1, swp2, and swn2 output from the control section 62, and the period of the triangular wave in the modulator 24 will now be explained. When the number of actuators 22 connected thereto (hereinafter also referred to as the number of driven actuators) varies, the frequency characteristics are varied. The frequency characteristics when the number of driven actuators varies are shown in FIG. 14. The larger the number of driven actuators, the more the gain is lowered, and the smaller the number of driven actuators, the more the gain is increased. This is because the actuators 22 are connected parallel to each other by the selection section. The actuators 22, such as a piezoelectric element, include a capacitance Cn. Every time an actuator 22, such as a piezoelectric element, is connected, the capacitance Cn of the actuator 22 is connected to the resistor R and the inductor L of the low-pass filter 26, shown in FIG. 15A, in parallel one after another, as shown in FIGS. 15B, 15C, and 15D, and the overall low pass filter is formed by the drive signal output circuit as a whole. If the drive signal output circuit forms a low pass filter, the waveform of the drive pulse applied to the actuator 22 is distorted.

Figure 16:
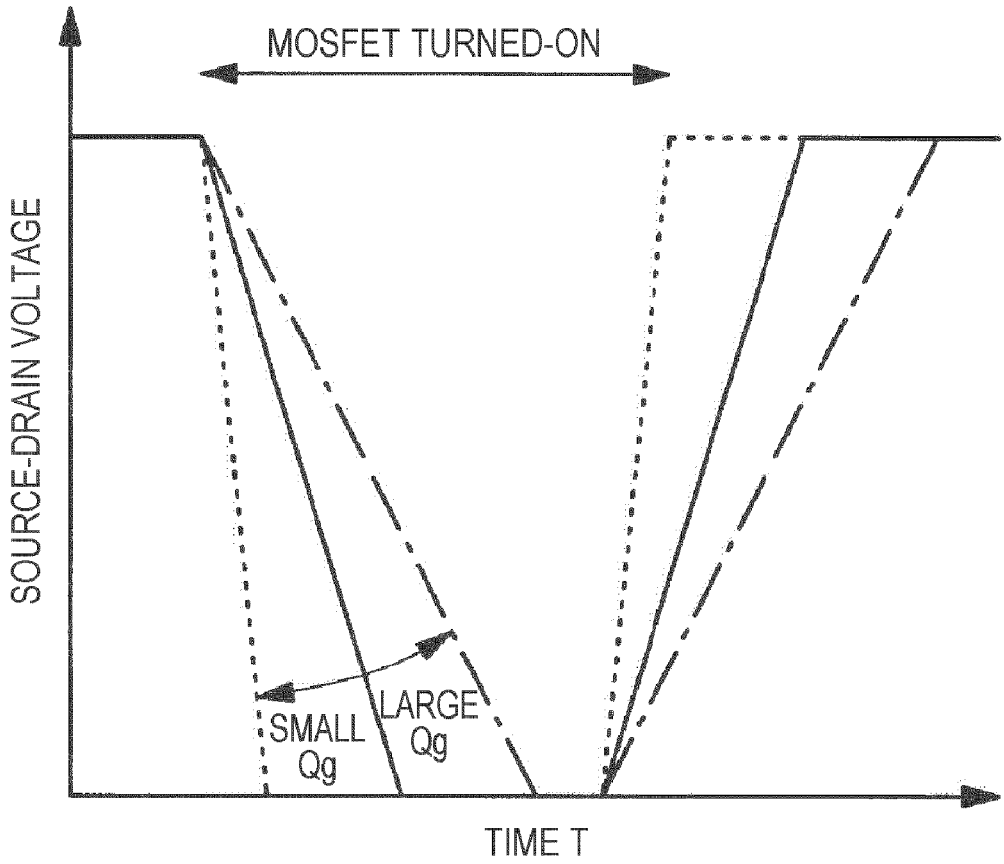
FIG. 16 is a characteristic diagram of the drain-source voltage when the gate capacitance of the MOSFET of the digital power amplifier is varied.

To summarize the specific problems, the waveform distortion of the drive pulse applied to the actuator 22 varies in accordance with the number of driven actuators, thus the amount of the liquid jet emitted from the nozzle varies to cause degradation of the image quality. Further, the amount of attenuation in the carrier frequency band of the modulated (PWM) signal also varies. In particular, when the number of driven actuators is small, the gain is increased, and the carrier frequency component remains in the generated waveform, namely the drive pulses, and the amount of the liquid jet emitted from the nozzle varies to cause degradation in the picture quality. In particular, in order to solve the latter problem, there is cited a method of raising the carrier frequency of the modulated (PWM) signal to reduce the remaining carrier frequency component in the drive pulse, i.e. so-called leakage of the carrier frequency component. In order to raise the carrier frequency, an element with a high switching speed, namely a MOSFET with a small gate capacitance is required in the digital power amplifier. However, when the number of driven actuators is large, the total capacitance of the actuators performing charge/discharge operations also becomes large; therefore, it becomes necessary to flow a large current between the drain and the source of the MOSFET. Although in this context, a MOSFET with a large chip size should be used to make the dynamic resistance, i.e. the on-resistance RDS (ON) small; there is a trade-off that such a MOSFET with a large chip size causes a large gate capacitance Qg. The relationship between the gate capacitance Qg and the drain-source voltage is shown in FIG. 16. When the gate capacitance Qg becomes larger, the charge/discharge time becomes longer, the switching speed is lowered and high-speed switching becomes more difficult. When the gate capacitance Qg is small, the switching speed becomes higher, and high-speed switching becomes possible.

Figure 17A:
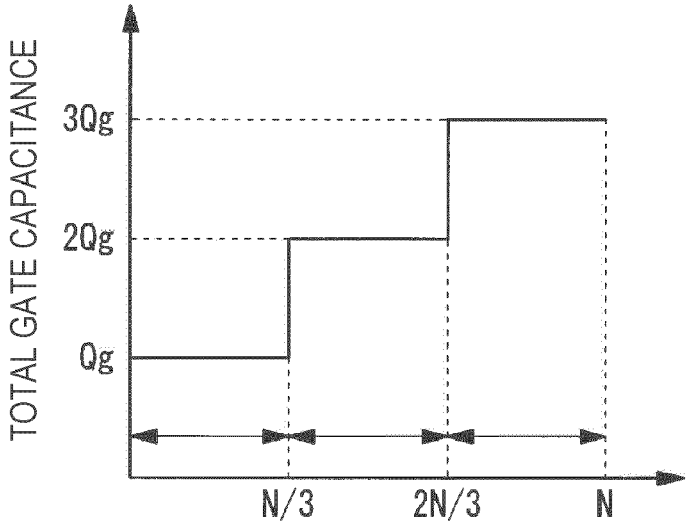
FIGS. 17A and 17B are explanatory diagrams of the total gate capacitance and the apparent on-resistance achieved by the digital power amplifier shown in FIG. 13.
Figure 17B:
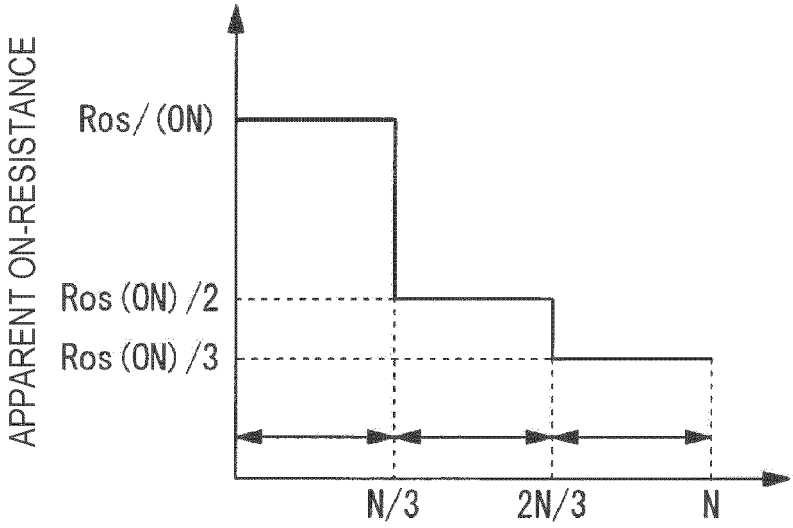

Therefore, in the present embodiment, the MOSFETs connected in a push-pull manner, namely the half-bridge drivers 33, are connected in parallel to the supply power VDD in the digital power amplifier 25 while the gate capacitances of these MOSFET are different from each other, and the kinds and the number of MOSFETs used for power amplification are adjusted in accordance with the number n of driven actuators, thereby changing the gate capacitance or the on-resistance to satisfy both high-speed switching and large current driving. Specifically, assuming that the total number of actuators is N, if the number n of driven actuators is equal to or smaller than N/3, the first high-side MOSFET TrP1 and the first low-side MOSFET TrN1 are driven; if the number n of driven actuators is larger than N/3 and equal to or smaller than 2N/3, the second high-side MOSFET TrP2 and the second low-side MOSFET TrN2 are driven; and if the number n of driven actuators is larger than 2N/3, the first high-side MOSFET TrP1, the first low-side MOSFET TrN1, the second high-side MOSFET TrP2, and the second low-side MOSFET TrN2 are driven. The total gate capacitance and the apparent on-resistance as the digital power amplifier 25 in this case becomes as shown in FIGS. 17A and 17B. Further, by adjusting the period of the triangular wave in accordance with the number n of driven actuators, the carrier frequency of the modulated (PWM) signal is varied, thereby satisfying both the reduction of leakage of the carrier frequency component and the reduction of switching loss.

Figure 18:
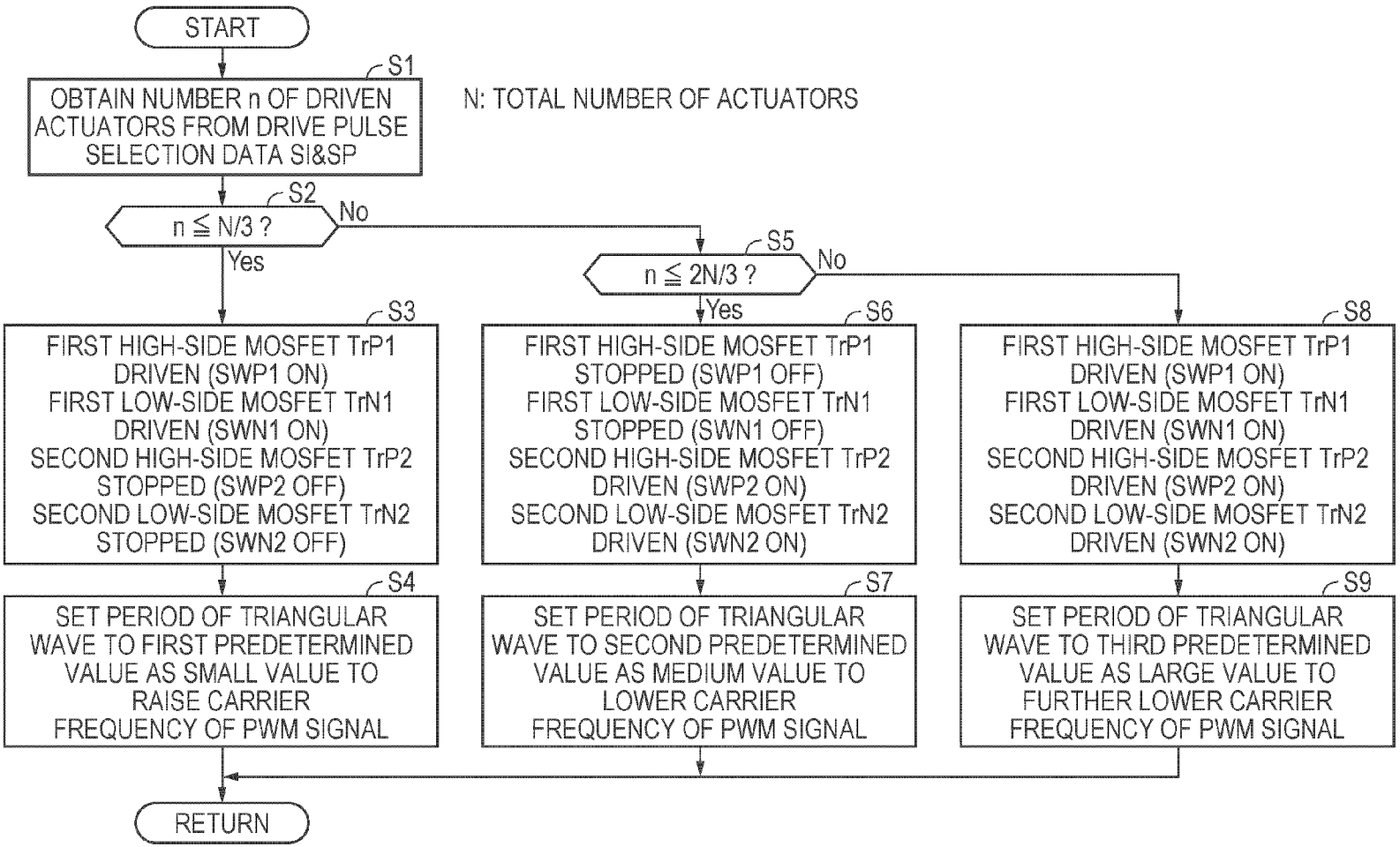
FIG. 18 is a flowchart showing the arithmetic process for adjusting the kinds and the number of MOSFETs and the period of a triangular wave in accordance with the number of actuators to be driven.

The arithmetic process for switching the MOSFETs and for switching the triangular wave period is illustrated in the flowchart of FIG. 18. The arithmetic process is performed every time the drive pulse selection data SI & SP corresponding to one line of the nozzle array is retrieved, and in step S1, the number n of driven actuators is obtained from the drive pulse selection data SI & SP.

Subsequently, the process proceeds to step S2 to determine whether or not the number n of driven actuators obtained in step S1 is less than or equal to a third of the total number N of the actuators, and if the number n of driven actuators is less than or equal to N/3, the process proceeds to step S3, otherwise the process proceeds to step S5.

In step S3, the first high-side MOSFET TrP1 and the first low-side MOSFET TrN1 are driven (the first high-side switch SWP1 and the first low-side switch SWN1 are turned on), the second high-side MOSFET TrP2 and the second low-side MOSFET TrN2 are stopped (the second high-side switch SWP2 and the second low-side switch SWN2 are turned off), and then the process proceeds to step S4.

In step S4, the period of the triangular wave is set to a first predetermined value, a smaller value, to raise the carrier frequency of the modulated (PWM) signal, and then the process returns to the main program.

In step S5, it is determined whether or not the number n of driven actuators obtained in step S1 is less than or equal to two thirds of the total number N of the actuators, and if the number n of driven actuators is less than or equal to 2N/3, the process proceeds to step S6, otherwise the process proceeds to step S8.

In step S6, the first high-side MOSFET TrP1 and the first low-side MOSFET TrN1 are stopped (the first high-side switch SWP1 and the first low-side switch SWN1 are turned off), the second high-side MOSFET TrP2 and the second low-side MOSFET TrN2 are driven (the second high-side switch SWP2 and the second low-side switch SWN2 are turned on), and then the process proceeds to step S7.

In step S7, the period of the triangular wave is set to a second predetermined value, a medium value, to lower the carrier frequency of the PWM signal, and then the process returns to the main program.

In step S8, the first high-side MOSFET TrP1, the first low-side MOSFET TrN1, the second high-side MOSFET TrP2, and the second low-side MOSFET TrN2 are driven (the first high-side switch SWP1, the first low-side switch SWN1, the second high-side switch SWP2, and the second low-side switch SWN2 are turned on), and then the process proceeds to step S9.

In step S9, the period of the triangular wave is set to a third predetermined value, a large value, to further lower the carrier frequency of the PWM signal, and then the process returns to the main program.

According to the present arithmetic process, if the number of driven actuators is small, the carrier frequency of the modulated (PWM) signal in the modulator 24 is raised and the total gate capacitance of the driven MOSFETs becomes small, and accordingly, high-speed switching of the MOSFETs becomes possible, and leakage of the carrier frequency component can be reduced by the high-speed switching of the MOSFETs and the increase in the carrier frequency. Further, if the number of driven actuators is large, the carrier frequency of the modulated (PWM) signal in the modulator 24 becomes lower, and the total gate capacitance of the MOSFETs to be driven becomes large, in other words, the apparent on-resistance becomes smaller, and accordingly, large current driving becomes possible, and switching loss caused by lowering the switching speed can also be reduced by lowering the carrier frequency.

As described above, according to the liquid jet apparatus and the printing apparatus of the present embodiment, the drive waveform signal WCOM, is generated by the drive waveform generator 70, the generated drive waveform signal WCOM is pulse-modulated by the modulator 24, the pulse-modulated signal is power-amplified by the digital power amplifier 25, and the power-amplified signal is smoothed by the low-pass filter 26, and is supplied to the actuator 22 as the drive signal COM. By setting the filter characteristic of the low-pass filter 26 capable of sufficiently smoothing only the power amplified modulated signal component, the drive signal COM can efficiently be power-amplified by the digital power amplifier 25 with low power loss while achieving a rapid rise and fall of the drive signal COM to the actuator 22, and the cooling unit, such as the heat radiation plate, can be eliminated.

Further, since the carrier frequency of the pulse modulation by the modulator 24 is adjusted in accordance with the number n of actuators 22 to be driven, reduction of leakage of the carrier frequency component and reduction of switching loss in the drive signal output circuit become possible.

Since the carrier frequency of the pulse modulation is raised when the number n of actuators 22 to be driven is small, and the carrier frequency of the pulse modulation is lowered when the number n of actuators 22 to be driven is large, the leakage of the carrier frequency component when the number n of actuators 22 to be driven is small is reduced, and the switching loss when the number n of actuators 22 to be driven is large is reduced.

Further, since the number of drive transistors (MOSFETs) of the digital power amplifier 25 is adjusted in accordance with the number n of actuators 22 to be driven, high-speed switching and large current driving become possible.

Further, since the number of drive transistors (MOSFETs) is lowered when the number n of actuators 22 to be driven is small and the number of drive transistors (MOSFETs) is increased when the number n of actuators 22 to be driven is large, the total capacitance of the transistors (MOSFETs) when the number n of actuators 22 to be driven is small is reduced to make high-speed switching possible, and the drive current when the number n of actuators 22 to be driven is large is distributed to a number of transistors (MOSFETs) to make large current driving possible.

It should be noted that although in the present embodiment, only the application of the present invention to the line head printing apparatus is explained in detail, the liquid jet apparatus and the printing apparatus according to the present invention can also be applied to a multi-pass printing apparatus or any other type of printing apparatus for printing letters or images on a print medium by emitting liquid jet as a target thereof. Further, each section configuring the liquid jet apparatus or the printing apparatus of the present invention can be replaced with an arbitrary configuration capable of exerting a similar function, or added with an arbitrary configuration.

Further, as a liquid emitted from the liquid jet apparatus of the present invention, there is no particular limitation, and liquids (including dispersion liquids, such as suspensions or emulsions) containing various kinds of materials as mentioned below are cited, for example. Specifically, ink containing a filter material of a color filter, a light emitting material for forming an EL light emitting layer in an organic electroluminescence (EL) device, a fluorescent material for forming a fluorescent substance on an electrode in a field emission device, a fluorescent material for forming a fluorescent substance in a plasma display panel (PDP) device, electrophoretic material for forming an electrophoretic substance in an electrophoretic display device, a bank material for forming a bank on a substrate W, various coating materials, a liquid electrode material for forming an electrode, a particle material for forming a spacer for forming a microscopic cell gap between two substrates, a liquid metal material for forming metal wiring, a lens material for forming a microlens, a resist material, a light diffusion material for forming a light diffusion material, and so on can be cited.

Further, in the present invention, the print medium to be a target of the liquid jet emission is not limited to a piece of paper, such as a recording sheet, but can be a film, a cloth, a nonwoven cloth, or other medium, or works, such as various substrates such as a glass substrate, or a silicon substrate.

What is claimed is:

1. A liquid jet apparatus comprising:

a plurality of nozzles;

an actuator provided for each nozzle and connected to the respective nozzle; and a drive unit that applies a drive signal to the actuator, wherein the drive unit includes:

a drive waveform signal generation unit that generates a drive waveform signal for controlling the operation of the actuator;

a modulator unit that pulse-modulates the drive waveform signal to produce a modulated signal;

a digital power amplifier having a plurality of transistors connected in parallel to a power supply for power-amplifying the modulated signal to produce an amplified signal;

a low-pass filter for smoothing the amplified signal to produce the drive signal and supplying the actuator with the drive signal; and a number of transistors adjusting unit that adjusts the number of drive transistors of the digital power amplifier in accordance with the number of actuators to be driven, wherein the number of transistors adjusting unit decreases the number of drive transistors when the number of actuators to be driven is less than or equal to a threshold amount, and increases the number of drive transistors when the number of actuators to be driven is greater than the threshold amount.

2. A printing apparatus comprising:

a plurality of nozzles;

an actuator provided for each nozzle and connected to the respective nozzle; and a drive unit that applies a drive signal to the actuator, wherein the drive unit includes:

a drive waveform signal generation unit that generates a drive waveform signal for controlling the operation of the actuator;

a modulator unit that pulse-modulates the drive waveform signal to produce a modulated signal;

a digital power amplifier having a plurality of transistors connected in parallel to a power supply for power-amplifying the modulated signal to produce an amplified signal;

a low-pass filter for smoothing the amplified signal to produce the drive signal and supplying the actuator with the drive signal; and a number of transistors adjusting unit that adjusts the number of drive transistors of the digital power amplifier in accordance with the number of actuators to be driven, wherein the number of transistors adjusting unit decreases the number of drive transistors when the number of actuators to be driven is less than or equal to a threshold amount, and increases the number of drive transistors when the number of actuators to be driven is greater than the threshold amount.

* * * * *